United States Patent [19]

Suzuki

[11] 4,184,870

[45] Jan. 22, 1980

[54] METHOD OF OBTAINING A NUMBER OF COPIES TRANSFERRED FROM ONE ELECTROSTATIC LATENT IMAGE

[75] Inventor: Yoshiro Suzuki, Hachioji, Japan

[73] Assignee: Olympus Optical Co., Limited, Toyko, Japan

[21] Appl. No.: 865,342

[22] Filed: Dec. 28, 1977

[30] Foreign Application Priority Data

Feb. 4, 1977 [JP] Japan ..... 52-10628

[51] Int. Cl.[2] ..... G03G 13/16; G03G 15/16

[52] U.S. Cl. ..... 430/53; 430/31; 355/3 TR

[58] Field of Search ..... 96/1 C, 1.4, 1 R

[56] References Cited

U.S. PATENT DOCUMENTS

| | | | |
|---|---|---|---|
| 2,965,756 | 12/1960 | Vyverberg | 96/1 C |
| 3,543,022 | 11/1970 | Lennon | 96/1 C |
| 3,676,118 | 7/1972 | Mott et al. | 96/1.4 |
| 3,788,739 | 1/1974 | Coriale | 96/1 C |
| 3,967,891 | 7/1976 | Rippstein | 96/1 C |
| 3,994,725 | 11/1976 | Volkers | 96/1.4 |

OTHER PUBLICATIONS

Schaffert "Electrophotography" 1965, pp. 30–31, 242–245.

*Primary Examiner*—Roland E. Martin, Jr.
*Assistant Examiner*—John L. Goodrow
*Attorney, Agent, or Firm*—Haseltine, Lake & Waters

[57] ABSTRACT

A method of obtaining a number of copies transferred from one electrostatic latent image produced on an electric charge carrying member coated on an electrically conductive transfer body is disclosed. The method comprises the successive steps of producing an electrostatic latent image charge on the transfer body, developing the electrostatic latent image charge into a toned picture image, applying a bias voltage between an electrically conductive screen arranged near a transfer receiving medium made in contact with the transfer body on the one hand and the transfer body on the other hand and at the same time charging the transfer receiving medium through the electrically conductive screen with a corona source of ions. The method can transfer the electrostatic latent image produced on the transfer body to the transfer receiving medium without damaging the electrostatic latent image at a high speed with a high efficiency.

3 Claims, 1 Drawing Figure

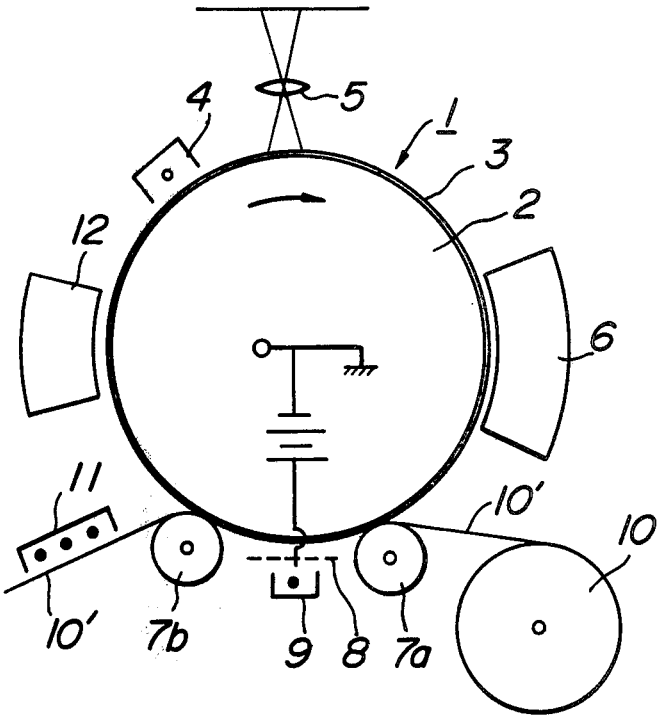
4
5
1
3
2
12
6
11
10'
10
10'
7b
9
8
7a

METHOD OF OBTAINING A NUMBER OF COPIES TRANSFERRED FROM ONE ELECTROSTATIC LATENT IMAGE

BACKGROUND OF THE INVENTION

1. Field of the Invention

This invention relates to a method of obtaining a number of copies transferred from one electrostatic latent image produced on an electric charge carrying member coated on an electrically conductive transfer body.

2. Description of the Prior Art

In prior art electrographic techniques, as means for transferring a picture image produced on a transfer body and developed by toner particles to a transfer receiving medium such as plain paper, a corona discharge transfer system, bias roll transfer system, etc. have been proposed.

In the conventional corona discharge transfer system, the rear surface of the transfer receiving medium is charged with a corona source of ions having a polarity which is opposite to that of toner particles so as to transfer the toned picture image to the plain paper. As a result, if the corona charging voltage is not high, it is difficult to uniformly charge the transfer receiving medium with the corona source of ions and hence it is difficult to eliminate undesirous transfer of the toned image to the transfer receiving medium. In addition, if use is made of a transfer receiving medium formed of plain paper, the plain paper has a resistance value of $10^{10}$ to $10^{14}$ Ωcm, so that if the corona charging voltage is made too high, a flow of corona ions is introduced through the plain paper into the transfer body, thereby deteriorating the electrostatic latent image produced on the transfer body.

In the conventional bias roll transfer system, an electrically conductive roller with or without an insulating film coated thereon is urged against the rear surface of a transfer receiving medium and a bias voltage is applied between the roller and the transfer receiving medium. In such transfer system, the force for urging the roller against the transfer receiving medium, the amount of toner particles adhered to the transfer body and the fluidity of toner particles cause a center portion of the picture image not to be transferred to the transfer receiving medium, thereby degrading the transfer efficiency. In order to improve the transfer efficiency, if the bias voltage is made high, the electrostatic latent image produced on the transfer body becomes deteriorated in the same manner as in the case of the corona discharge transfer system. As a result, it is difficult, in general, to apply the bias roll transfer system to a high speed transfer process.

The above described conventional transfer systems have been encountered with difficult problems that the electrostatic latent image becomes damaged due to the corona charging voltage and bias voltage and that the toned picture image is considerably disturbed due to discharge which is produced when the transfer receiving medium is detached from the transfer body and hence the quality of the picture becomes degraded or the picture image is overdeveloped to show spots therein. As a result, it is difficult to obtain a number of copies from the sole electrostatic latent image produced on the transfer body.

SUMMARY OF THE INVENTION

An object of the invention, therefore, is to provide a method of obtaining a number of copies from one electrostatic latent image, which can eliminate various drawbacks which have been encountered with the prior art electrographic techniques, that is, which can obtain a number of copies from a sole electrostatic latent image produced on a transfer body without deteriorating the electrostatic latent image at a high speed with an excellent transfer efficiency.

A feature of the invention is the provision of a method of obtaining a number of copies transferred from one electrostatic latent image produced on an electric charge carrying member coated on an electrically conductive transfer body, comprising forming an electrostatic latent image charge on the transfer body, developing the electrostatic latent image charge into a toned picture image for each of the number of copies being transferred, applying a bias voltage between an electrically conductive screen arranged near a transfer receiving medium made in contact with the transfer body on the one hand and the transfer body on the other hand and at the same time charging the transfer receiving medium through the electrically conductive screen with a corona source of ions, so as to transfer the toned picture image produced on the transfer body to the transfer receiving medium.

DESCRIPTION OF THE DRAWING

The invention will now be described in greater detail with reference to the FIGURE, wherein:

The sole FIGURE diagrammatically illustrates an embodiment of successive steps of a method according to the invention.

DESCRIPTION OF THE PREFERRED EMBODIMENT

In the embodiment shown in the drawing, a transfer body 1 is composed of an electrically conductive support roller 2 rotatable in a direction shown by an arrow and a photoconductive thin film layer 3 coated around the roller 2 and formed of selenium, for example, so as to carry an electric charge thereon. On the transfer body 1 is produced an electrostatic latent image charge by means of a conventional method of producing an electrostatic latent image. For this purpose, a corona discharge device 4 is utilized to provide a uniform positive charge on the surface of the photoconductive thin film layer of the transfer body 1. Then, the photoconductive thin film layer 3 is illuminated through a projection lens 5 by an optical image to produce, on the photoconductive thin film layer 3, an electrostatic charge patterns corresponding to the optical image. The electrostatic charge patterns are developed to a visible image by a developing device 6 which functions to effect a conventional toner development such, for example, as a cascade development, magnetic brush development, etc. A toned picture image formed on the transfer body 1 is then transferred to a transfer receiving medium, for example, plain paper.

In the present embodiment, a pair of spaced apart electrically conductive rollers 7*a*, 7*b* are arranged at the transfer position and made in contact with the transfer body 1. Between the electrically conductive rollers 7*a* and 7*b* are arranged an electrically conductive screen 8 having meshes of the order of 10 to 200 and separated from and opposed to the transfer body 1. A second corona discharge device 9 is located at the side of the electrically conductive screen 8 which is opposite to the transfer body 1. A transfer receiving medium 10', in the present embodiment, plain paper is delivered from a paper feed roll 10 and fed through the pair of electrically conductive rollers 7a, 7b while slightly urged against the transfer body 1. In this case, the second corona discharge device 9 directs a flow of corona ions having a polarity which is the same as that of the electrostatic latent image charge produced on the transfer body, but is opposite to that of the toned picture image charge through the electrically conductive screen 8 toward the transfer receiving medium. In the present embodiment, the second corona discharge device 9 directs a flow of corona ions having a positive polarity. As a result, the toned picture image formed on the transfer body 1 is transferred to the transfer receiving medium 10'. The toned picture image on the transfer receiving medium 10' is finally fed to a fixing device 11 which functions to fix the toned picture image by fusing or pressing to obtain final visible copies of the picture image.

In the case of charging the transfer receiving medium 10' with the corona source of ions by the second corona discharge device 9, a proper bias voltage is applied between the transfer body 1 and the electrically conductive screen 8. Experimental tests have yielded the result that if the transfer receiving medium 10' is charged with the corona source of ions through the biased electrically conductive screen 8 by the second corona discharge device 9, the toned picture image is transferred from the transfer body 1 to the transfer receiving medium 10' without damaging the electrostatic latent image charge produced on the transfer body 1 and without degrading the transfer efficiency.

For example, no damage occurs on the electrostatic latent image charge produced on the transfer body 1 under such conditions that the bias voltage applied to the electrically conductive screen 8 is +100 V to +400 V and that the charging voltage of the second corona discharge device 9 is +4 KV to +7 KV. In addition, the electrically conductive screen 8 functions to control the flow of corona ions from the second corona discharge device 9 to the transfer receiving medium 10' so as to improve the uniformity of charge of corona source of ions. As a result, the range over which the corona source of ions is charged becomes widened and the transfer time becomes substantially long, thereby rendering the transfer efficiency significantly high.

As described above, the transfer receiving medium 10' is slightly urged against the roller-shaped transfer body 1 and fed by the pair of electrically conductive rollers 7a, 7b. As a result, the transfer receiving medium 10' becomes closely in contact with the transfer body 1, so that there is no risk of the transfer being degraded. In addition, the transfer speed becomes considerably higher than that of the above described bias-roll transfer system. For example, a transfer receiving plain paper having an A4 size can be subjected to the transfer step at a speed of the order of 60 sheets/minute.

The electrically conductive roller 7b is located at that position of the transfer body 1 from which the transfer receiving medium 10' is released after the transfer step has been completed. As a result, it is possible to effectively prevent occurrence of discharge between the transfer receiving medium 10' and the transfer body 1. Therefore, there is no risk of the electrostatic latent image once produced on the transfer body 1 being damaged and of the quality of the picture image being degraded or of over development being involved due to disturbance of the toned picture image.

As described above, the electrostatic latent image produced on the transfer body 1 can be transferred to the transfer receiving medium 10' without damaging the electrostatic latent image at a high speed with a high efficiency. As a result, next successive steps of producing the electrostatic latent image on the transfer body 1 can be omitted and a repetition of the development step and the transfer step renders it possible to obtain a number of copies transferred from one electrostatic latent image.

Experimental tests have yielded the result that a number of copies inclusive of a second to several tenth copy are substantially the same in picture quality as the first copy.

After the transfer operations for a desired number of copies have been completed, the residual toner and electric charge are erased from the surface of the transfer body 1 in a conventional manner by a cleaning device 12 so as to make the transfer body 1 ready for the next production of the electrostatic latent image thereon.

As described above, in accordance with the invention, the corona source of ions for transferring the toned picture image produced on the transfer body to the transfer receiving medium is controlled by the electrically conductive screen, so that it is possible to prevent the corona charge from being introduced through the transfer receiving medium into the transfer body and hence effectively prevent the electrostatic latent image produced on the transfer body from being damaged. In addition, the use of the electrically conductive screen for controlling the corona charge ensures a widening of the area being transferred and provides the important advantage that the transfer efficiency can be improved.

The invention is not limited to the above described embodiment only, but various changes and modifications may be made. For example, in the above described embodiment, the electric charge carrying member constituting the surface thin film layer of the transfer body 1 is formed of a photoconductive substance such as selenium and the like. Alternatively, the electric charge carrying member may be formed of substance having an excellent electric charge carrying property or having a high dielectric constant and a high insulating property such, for example, as a glass film containing a large amount of lead or an organic resin such as acryl resin, polyurethane, polystyrol, polyethylene and the like. Since the photoconductive substance generally has a dark decay characteristic, it is preferable to use the substance having the high dielectric constant and the high insulating property. In the case of using a transfer body whose electric charge carrying member is formed of nonphotoconductive substance, the electrostatic latent image charge may be produced on the transfer body with the aid of TESI (Transfer of Electrostatic Image) system, flow of corona ions control screen system, multistylus system of producing electrostatic latent image known in facsimile, etc.

Experimental tests have shown the result that if the flow of corona ions control screen system, for example, is used to produce, on a glass film transfer body having a thickness of 30μ to 60μ, an electrostatic latent image having an electric potential of about −200 V to −300 V, the method according to the invention can continuously transfer such electrostatic latent image to a transfer receiving medium and obtain several tens copies.

What is claimed is:

1. A method of obtaining a number of copies transferred from one electrostatic latent image produced on an electric charge carrying member coated on an electrically conductive transfer body, comprising the steps of producing an electrostatic latent image charge on said transfer body, developing said electrostatic latent image charge into a toned picture image for each of the number of copies being transferred, applying a bias voltage between an electrically conductive screen arranged near a transfer receiving medium made in contact with the transfer body and the transfer body at the same time charging said transfer receiving medium through said electrically conductive screen with a corona source of ions so as to transfer said toned picture image produced on said transfer body to said transfer receiving medium.

2. The method according to claim 1, wherein said transfer receiving medium is delivered from a feed roll through a pair of spaced apart electrically conductive rollers arranged at the transfer position and made in contact with said transfer body.

3. The method according to claim 1, wherein said transfer receiving medium is charged through said electrically conductive screen by a flow of corona ions directed from a corona discharge device located at that side of said electrically conductive screen which is opposite to said transfer body.

* * * * *